US005606884A

United States Patent [19]

Pettersson et al.

[11] Patent Number: 5,606,884

[45] Date of Patent: Mar. 4, 1997

[54] METHOD AND APPARATUS FOR PRODUCING HELICALLY-WOUND LOCK-SEAM TUBING WITH REDUCED LUBRICATION

[75] Inventors: Conny Pettersson, Laholm; Donald Niklasson, Båstad, both of Sweden

[73] Assignee: Lindab AB, Sweden

[21] Appl. No.: 497,018

[22] Filed: Jun. 30, 1995

[51] Int. Cl.[6] ..... B21B 45/02; B21C 37/12

[52] U.S. Cl. ..... 72/41; 72/49; 72/43

[58] Field of Search ..... 72/39, 41, 43, 72/49, 50, 51, 52

[56] References Cited

U.S. PATENT DOCUMENTS

| | | | |
|---|---|---|---|
| 2,136,943 | 11/1938 | Freeze . | |
| 3,750,439 | 8/1973 | Pratt | 72/43 |
| 4,597,276 | 7/1986 | Legallais et al. | 72/49 |
| 4,706,481 | 11/1987 | Castricum | 72/49 |
| 4,895,011 | 1/1990 | Varga | 72/49 |
| 5,079,939 | 1/1992 | Shook | 72/43 |

FOREIGN PATENT DOCUMENTS

| | | |
|---|---|---|
| 671897 | 7/1979 | U.S.S.R. . |
| 835558 | 6/1981 | U.S.S.R. . |
| 2213748 | 10/1991 | United Kingdom . |

*Primary Examiner*—Lowell A. Larson
*Assistant Examiner*—Rodney A. Butler
*Attorney, Agent, or Firm*—Weingarten, Schurgin, Gagnebin & Hayes LLP

[57] ABSTRACT

In a method and an apparatus for producing helically-wound lock-seem tubing from a metal strip having longitudinal edge portions, the strip is fed to a forming head and formed into helical shape. A lubricant is locally supplied on that side of the strip which forms the outside of the tube, said lubricant being supplied over only a limited portion of the width of the strip.

9 Claims, 2 Drawing Sheets

METHOD AND APPARATUS FOR PRODUCING HELICALLY-WOUND LOCK-SEAM TUBING WITH REDUCED LUBRICATION

FIELD OF THE INVENTION

The present invention relates to the production of helically-wound lock-seam tubing, and more specifically concerns a method and an apparatus for such production with a reduced need of lubrication.

BACKGROUND ART

Known machines for producing helically-wound lock-seam tubing are disclosed by, for example, British Patent Publication GB 2,213,748 and U.S. Pat. No. 4,706,481. These machines are well-known to the person skilled in the art and thus need not to be described in any detail here. Several further developments of such machines are available on the market, but these machines still suffer from certain drawbacks, as will be discussed in the following.

The metal strip used for the production in question is normally coated with zinc in order to be able to withstand corrosion. The metal strip is thus galvanised, which leads to problems that are well-known to the skilled person.

When the metal strip is edge-formed in the roller assembly preceding the forming head, small fragments of zinc are released from the metal strip and adhere to the edge-forming rollers. Owing to these zinc fragments, the diameter of the edge-forming rollers increases, especially in the last pair of rollers. Since these rollers are not resiliently journalled, the clamping force in the nip beneath two rollers is considerably increased as a result of the build-up of zinc on the rollers. In severe cases, these undesirable forces are so significant that the rollers are broken, which causes stoppages of production.

Another problem is that zinc fragments are released as a result of the sliding of the metal strip between the guiding plates before the forming head, which leads to a build-up of zinc on the opposite faces of these guiding plates. If the build-up of zinc on the guiding plates is too considerable, the feeding of the metal strip between the guiding plates can be disturbed.

Another disadvantage is that the zinc coating on the metal strip is softened and adheres to the insider of the forming head owing to significant frictional forces and heat development in the forming head. This renders more difficult the forming of the tubing in the forming head.

Hitherto, the problems related to the released zinc fragments have been solved by supplying lubricant, normally oil, to the metal strip on different places in the machine. For example, such lubrication is discussed in U.S. Pat. No. 2,136,943. Lubrication of metal strips is also discussed in U.S. Pat. No. 3,750,439 and the Russian Publication No. 835,558.

In more machines available on today's market, the oil is, however, supplied to the metal strip in a very simple manner. Traditionally, the lower roller of the first pair of rollers in the edge-forming assembly is permanently immersed in oil in a trough, by means of which oil is supplied over the total width of the metal strip. However, this arrangement suffers from several drawbacks, as will be discussed below.

As the roller immersed in oil in the oil trough rotates, oil is spread to the upper surface of the metal strip, which later will form the inside of the tube. The finished tubes are thus covered with oil on both the inside and the outside, which has unfavourable consequences.

If the tubes are used in ventilation duct systems, dust and other particles accumulate on the inside of the tube, which in turn becomes the breeding-ground of bacteria, virus, mould and the like, which may be dangerous to people's health. Further, accumulated dirt on the inside of the tube causes reduction of the tube inner cross-section with the consequence that the air flow rates and ventilation efficiencies for which the tube was originally designed are no longer upheld.

Similarly, dust and other particles accumulate on the outside of the tubes, making them unpleasant to handle for the personnel. Further, the tubes have to be cleaned on the outside if they are to be painted.

During transportation, tubes of smaller diameter are often inserted in tubes of greater diameter in order to save space. Oil on the outside of the smaller tubes is then transferred to the inside of the bigger tubes.

A special disadvantage is that an excess of oil in the lock seem may cause the tube to "spin" or slide during transportation and handling. As a result of such a spin, the tube diameter increases and consequently the sealing is impaired and standard components cannot be fitted on the tube.

In recent years, the demand for oil-free, helically-wound lock-seam tubing has increased, and the finding of a solution to the above-mentioned problems is therefore of great interest.

SUMMARY OF THE INVENTION

It is therefore an object of the present invention to remedy the above-mentioned drawbacks by providing a method and an apparatus for producing helically-wound lock-seam tubing using a medium of lubricants.

An object of the invention is to provide the production of helically-wound lock-seam tubes which are pleasant to handle for the personnel.

Another object of the invention is to provide a method and an apparatus which are easily adapted to existing machines. The tubing produced in accordance with the invention may, for example, be used in ventilation duct systems.

These objects are achieved by a method for producing helically-wound lock-seam tubing from a metal strip having longitudinal edge portions, comprising the steps of feeding said strip to a forming head; forming said strip into helical shape in said forming head, whereby said edge portions of said helically-wound strip are brought into engagement with each other; clinching said engaging edge portions of said strip to form a helically-wound lock-seam on a tube formed in said forming head; feeding said helically-wound lock-seam tube out of said forming head; and, before said forming head, supplying a lubricant locally on that side of said strip which forms the outside of said tube, said lubricant being supplied over only a limited portion of the width of said strip.

The above objects are also achieved by an apparatus for producing helically-wound lock-seam tubing from a metal strip having longitudinal edge portions, comprising means for feeding said strip to a forming head; means for forming said strip into helical shape in said forming head and for bringing said edge portions of said helically-wound strip into engagement with each other; a clinching assembly for clinching said engaging edge portions of said strip to form a helically-wound lock seam on a tube formed in said forming head; means for feeding said helically-wound lock-seam tube out of said forming head; and, before said forming head, means for locally supplying a lubricant to that said of said strip which forms the outside of said tube, said lubricant being supplied over only a limited portion of the width of said strip.

Practical tests of the invention using oil as lubricant have yielded excellent results. Compared with conventional production in accordance with the above description of the background art, the oil on the outside of the finished tube has been reduced by at least 25%, and the inside of the tube is almost free from oil. Since no oil trough is used and much less oil is spread, the surroundings of the machine are much more pleasant for the operator.

BRIEF DESCRIPTION OF THE DRAWINGS

The invention will now be described in more detail with reference to the accompanying drawings showing preferred embodiments of the invention. In the drawings, FIG. 1 schematically illustrates an embodiment of the apparatus according to the invention.

DESCRIPTION OF PREFERRED EMBODIMENTS

Figure 1:
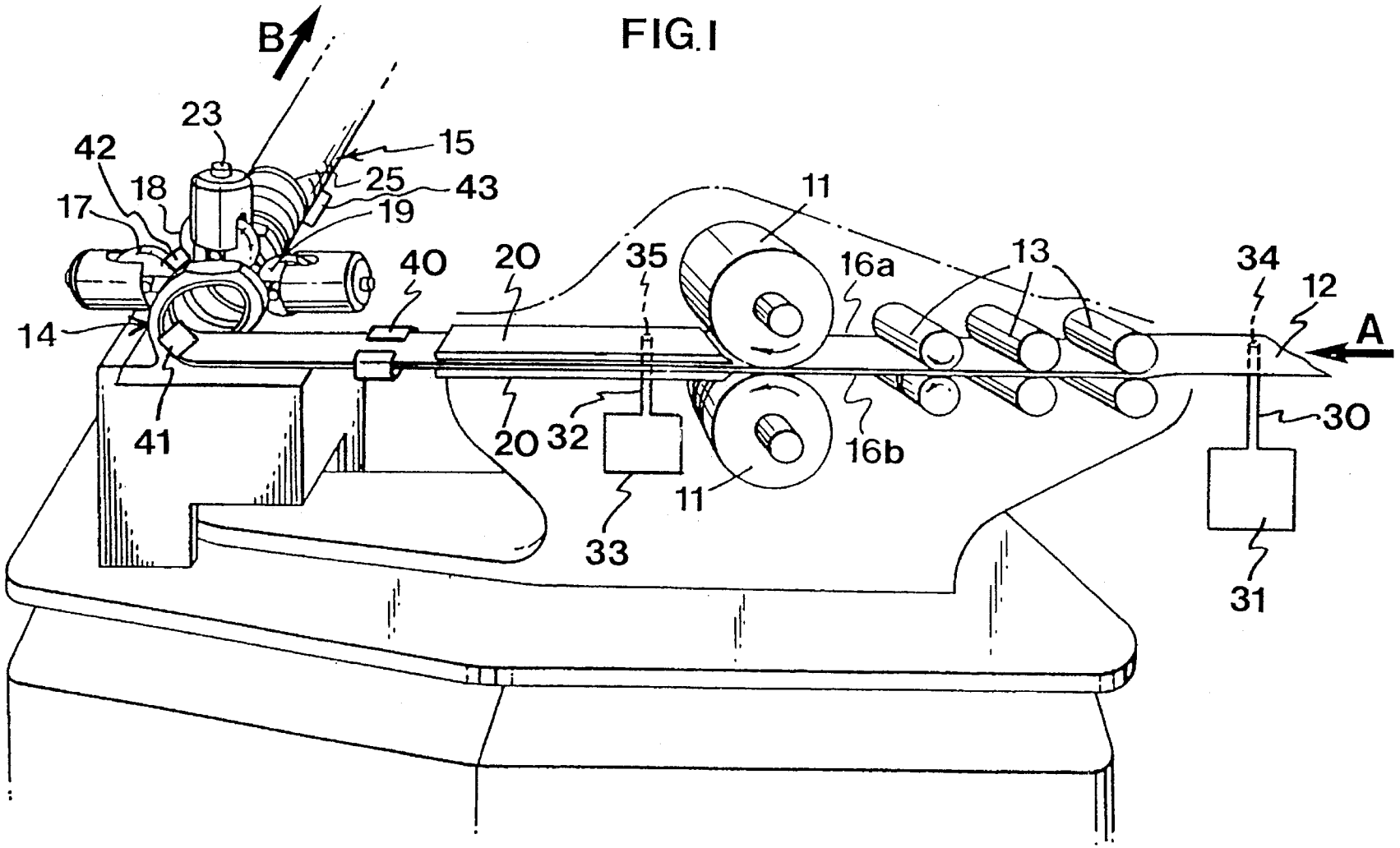

As shown in FIG. 1, drive rollers 11 feed a metal strip 12 (arrow A) through an edge-forming assembly having rolls 13, by which longitudinal edge portions 16*a*, 16*b* are formed. The metal strip 12 is formed and helically wound in a forming head 14 in a known manner for producing a tube 15. The forming head 14 has clinching rollers 17–19 for forming a lock seam 25 on the tube 15 fed out of the forming head 14 (arrow B). A pair of guiding plates 20 are arranged between the drive rollers 11 and the forming head 14, as is conventional.

A conduit 30 for supplying a lubricant, for example oil, to the metal strip 12 is arranged under the edge-forming assembly 13. The conduit 30 is connected to an oil supply 31. Optionally, a similar oil conduit 32 and an oil supply 33 may be arranged after the drive rollers 11, as will be discussed below.

Figure 2:
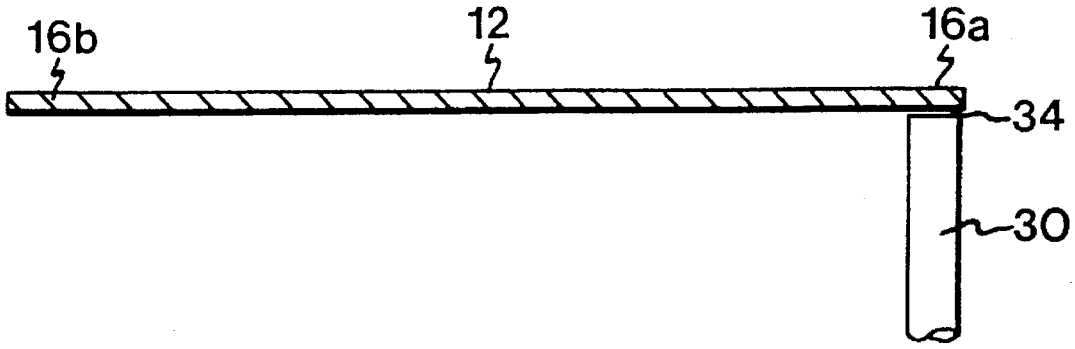
FIG. 2 shows a cross-section of the metal strip before the edge-forming assembly.
Figure 4:
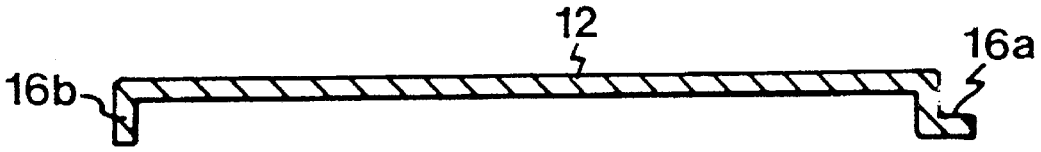
FIG. 4 shows a cross-section of the metal strip after the edge-forming assembly.

As can be seen in FIG. 2, the oil conduit 30 is disposed at the edge portion 16*a*, which in the edge-forming assembly 13 is given the shape of a Z (see FIG. 4). The oil conduit 30 has a supply opening 34, which is either applied to the strip 12 or disposed at a short distance therefrom.

Figure 3:
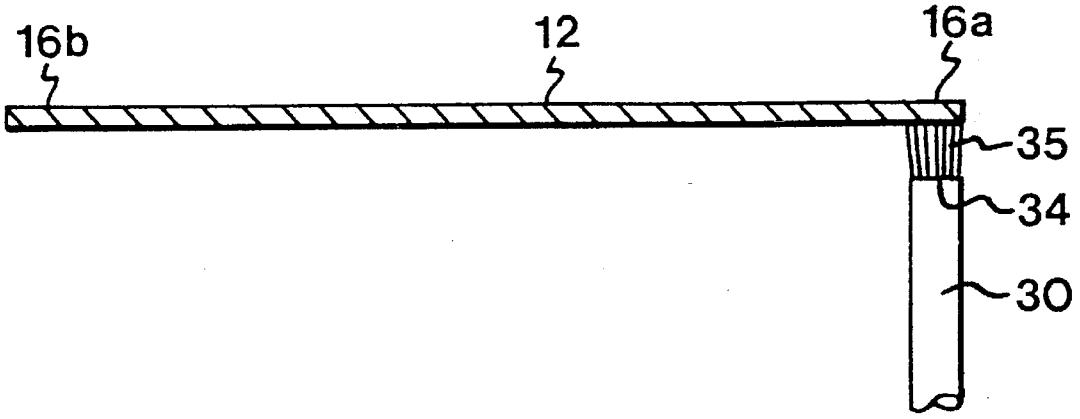
FIG. 3 is a view similar to FIG. 2 but shows another embodiment of the lubricant-supplying means.

In the embodiment shown in FIG. 3, the supply opening 34 of the oil conduit 30 is disposed at a greater distance from the metal strip 12, but there is a brush member 35 provided at the end of the conduit 30. The brush member 35 is in permanent engagement with the metal strip 12 and compensates for any vertical movements of the strip 12 in production.

FIG. 4 shows the Z-shaped edge portion 16*a* and the L-shaped edge portion 16*b*, which are formed in the edge-forming assembly.

Since oil is supplied locally and only on that side of the strip 12 which forms the outside of the tube 15, the finished tube 15 is almost free from oil on the inside. As is clearly understood from FIGS. 2 and 3, oil is applied to the strip 12 over only a very limited portion of the width of the strip 12. No oil is spread to the upper side of the strip 12.

In order to ensure that no zinc fragment build-up takes place on the inside of the guiding plates 20, a corresponding oil supply assembly 32, 33 may optionally be provided after the drive rollers 11. The oil conduit 32 has an opening 35 disposed in a corresponding opening 35 in the lower guiding plate 20.

In order to further reduce the amount of oil on the strip 12, scraper means 40–43 can be provided before, in connection with and after the forming head 14. In practice, the scraper 40 comprises rubber lips (not shown) gripping around the edge portions 16*a*, 16*b* of the strip 12. Preferably, the scraper 41 on the forming head 14 also has rubber lips (not shown), whereas the scraper 42 arranged in an opening (not shown) of the forming head 14 has means (for example of paper) for absorbing oil. The scraper 43 arranged on the outside of the tube 15 can be of any suitable type, preferably a rubber lip member.

Finally, it should be mentioned that the invention is by no means restricted to the embodiments described herein, but that several modifications are conceivable within the inventive concept and the scope of the appended claims. For example, the apparatus can be provided with further scraper and wiper means for the removal of oil. Further, the brush member can be of any other suitable design.

What we claim and desire to secure by Letters Patent is:

1. A method for producing helically-wound locks-seam tubing having reduced lubrication from a metal strip having longitudinal edge portions, comprising the steps of:

feeding said strip to a forming head;

forming said strip into helical shape in said forming head, whereby said edge portions of said helically-formed strip are brought into engagement with each other;

clinching said engaging edge portions of said strip to form a helically-wound lock seam on a tube formed in said forming head;

feeding said helically-wound lock-seam tube out of said forming head; and before said forming head, supplying a lubricant locally and exclusively on that side of said strip which forms the outside of said tube, said lubricant being supplied over only a limited portion of the width of said strip, said lubricant supplied to said strip at a point adjacent to one of said edge portions of said strip.

2. The method of claim 1, wherein said edge portions of said strip are edge-formed in an edge-forming assembly preceding said forming head, said lubricant being supplied to said strip before said edge-forming assembly.

3. The method of claim 2, wherein a first one of said edge portions of said strip is edge-formed in such a way that a partial cross-section through said first edge portion is Z-shaped, whereas a second one of said edge portions of said strip is edge-formed in such a way that a partial cross-section through said strip is L-shaped, said lubricant being supplied to said strip adjacent to said Z-shaped edge portion.

4. An apparatus for producing helically-wound lock-seam tubing having reduced lubrication from a metal strip having longitudinal edge portions comprising:

means for feeding said strip to a forming head;

means for forming said strip into helical shape in said forming head and for bringing said edge portions of said helically-wound strip into engagement with each other;

a clinching assembly for clinching said engaging edge portions of said strip to form a helically-wound lock seam on a tube formed in said forming head;

means for feeding said helically-wound lock-seam tube out of said forming head; and before said forming head, means for locally and exclusively supplying a lubricant of that side of said strip which forms the outside of said tube, said lubricant being supplied over only a limited portion of the width of said strip, said lubricant being supplied by a conduit having a supply opening disposed adjacent to one of said edge portions of said strip.

5. The apparatus of claim 4, wherein said opening of said lubricant-supplying conduit is applied to said strip.

6. The apparatus of claim 4, wherein said opening of said lubricant-supplying conduit is disposed at a distance from said strip.

7. The apparatus of claim 4, further comprising an assembly for forming said edge portions before said forming head, said lubricant-supplying means being arranged before said edge-forming assembly.

8. The apparatus of claim 6, wherein said lubricant-supplying conduit has a brush member which is provided at said opening and which is in permanent engagement with said strip.

9. The apparatus of claim 7, wherein said edge-forming assembly comprises means for forming a first one of said edge portions in such a way that a partial cross-section through said first edge portion is Z-shaped, said edge-forming assembly further comprising means for forming a second one of said edge portions of said strip in such a way that a partial cross-section through said strip is L-shaped, said lubricant-supplying means being so arranged that lubricant is supplied to said strip adjacent to said first Z-shaped edge portion.

* * * * *

UNITED STATES PATENT AND TRADEMARK OFFICE

CERTIFICATE OF CORRECTION

PATENT NO. : 5,606,884

DATED : March 4, 1997

INVENTOR(S) : Conny Pettersson et al.

It is certified that error appears in the above-indentified patent and that said Letters Patent is hereby corrected as shown below:

In the Abstract, line 2, "lock-seem" should read --lock-seam--.

Column 1, line 33, "beneath" should read --between--.

Column 1, line 46, "insider" should read --inside--.

Column 1, line 58, "more" should read --most--.

Column 2, line 22, "seem" should read --seam--.

Column 2, line 36, "medium" should read --minimum--.

Column 3, line 3, "said" should read --side--.

Column 3, line 22, "." should read --,--.

Column 4, line 29, "locks-seam" should read --lock-seam--.

Signed and Sealed this

Thirtieth Day of September, 1997

*Attest:*

Bruce Lehman

BRUCE LEHMAN

*Attesting Officer*

*Commissioner of Patents and Trademarks*